United States Patent [19]

Bergen

[11] Patent Number: 4,516,798

[45] Date of Patent: May 14, 1985

[54] LATCH BOLT OPERATING ASSEMBLY HAVING BOLT OPERATING IMPROVEMENTS

[75] Inventor: Gary R. Bergen, Yorba Linda, Calif.

[73] Assignee: Emhart Industries, Inc., Farmington, Conn.

[21] Appl. No.: 483,550

[22] Filed: Apr. 11, 1983

[51] Int. Cl.[3] ..... E05C 1/16

[52] U.S. Cl. ..... 292/169.13

[58] Field of Search ..... 292/167, 169–169.23, 292/36

[56] References Cited

U.S. PATENT DOCUMENTS

| | | | |
|---|---|---|---|
| 2,711,920 | 6/1955 | Farnsworth | 292/169.13 |
| 2,776,155 | 1/1957 | Gerloch | 292/337 X |
| 3,172,691 | 3/1965 | Russell | 292/337 X |
| 3,203,719 | 8/1965 | Moore | 292/167 |
| 3,353,858 | 11/1967 | Neary et al. | 292/169.13 X |

*Primary Examiner*—Richard E. Moore

*Attorney, Agent, or Firm*—George E. Schick

[57] ABSTRACT

Retracting motion is imparted through door knobs or levers into a transverse half-round spindle which, in turn, longitudinally moves a retractor slide. The retractor slide is forwardly pivotally connected through a link to a cam having its rearward end pivotal on the frame and its forward end engaged with a main bolt. The main bolt is a spring latch bolt connected to the cam by a slideable unlocking slide movably enclosed by a U-shaped bolt extension with the unlocking slide also actionable with a locking dog controlled by an auxiliary bolt. In normal operation the main bolt is extended within a strike plate and the auxiliary bolt is retracted bearing against the strike plate so that rearward movement rearwardly pivots the cam which withdraws the main bolt through rearward abutment of the unlocking slide which bears rearwardly against the bolt extension, the auxiliary bolt also being withdrawn due to the unlocking slide ultimately acting against the locking dog and the auxiliary bolt. When, however, attempts are made to drive the main bolt from its extended position by forces against the main bolt, the cam and unlocking slide remain stationary and the bolt and bolt extension move rearwardly independently which causes the locking dog to ultimately dog the main bolt in its extended position frustrating the driving attempt. A backset adjustment may also be provided, a forward backset by an insert engaged with the retractor slide transmitting motion from the spindle into the insert and ultimately into the retractor slide, and a rearward backset adjustment being merely the retractor slide with the inserts removed.

22 Claims, 14 Drawing Figures

LATCH BOLT OPERATING ASSEMBLY HAVING BOLT OPERATING IMPROVEMENTS

BACKGROUND OF THE INVENTION

This invention relates to latch constructions of the type provided for doors and the like, and more particularly to such latch constructions having bolt operating improvements. Even more particularly, this invention relates to one or both of two distinct areas of bolt operating improvement, one of transferring motion from a latch bolt to an operator therefor in order to smoothly and efficiently operate the latch, and the other of transferring motion between an auxiliary bolt and a main bolt when the auxiliary bolt is provided to ensure positive dogging of the main bolt in an improved manner with maximum resistance against attempted violation thereof. Furthermore, this invention may further include an improved backset adjustment added to either or both of the foregoing to provide maximum adjustment versatility where that is desired in the overall combination. Most prior latch constructions of the type provided for doors and the like in their transferring of motion from their rearward operator forwardly through their latch operating mechanism into the bolt thereof have necessarily been of quite a complex nature if the latch construction is to continuously operate in the required dependable manner, while still being resistant to violation by outside forces. This is particularly true of the spring latch type which requires positive mechanical motion for movement from bolt engaged to bolt disengaged positions, but makes use of merely spring pressure for opposite movement back to the bolt engaged position. There is a clear want and need for a more simplified mechanical structure serving the required mechanical motion and yet one which will provide equivalent or increased positive dependability regardless of the direction of motion transfer, that is, the mechanical motion during bolt disengagement or the spring derived motion of the bolt re-engagement.

Furthermore, in keeping with the modern trends in our society, latch constructions regardless of the type thereof although particularly applicable to spring latch constructions, particularly require any possible increases in security while still maintaining the latch construction reasonably conveniently usable. One of the major increases is that of bolt projection, for instance, from the door into the keeper of the door frame. Few will argue that increased bolt projection provides increased security yet these increases must be contained within a limited amount of space in order to make the particular latch construction of a viable nature. It, therefore, becomes a goal in latch constructions to provide the motion transfer elements not only of proper use, but clearly with maximum adjustment versatility within the overall construction so that the maximum of mechanical advantages may be incorporated therein.

Still in keeping with the foregoing violation deterrents, another obvious area which can always be improved in latch constructions of the spring latch type is the dogging of the main bolt by the auxiliary bolt for engagement securement. In most prior spring latch constructions, the dogging or blocking for movement has usually been carried out by a locking dog between the main bolt and the auxiliary bolt so that with the main bolt extended engaging the strike within the door frame and the auxiliary bolt retracted by the strike, the locking dog bears against the main bolt retaining it in its extended position. Furthermore, this particular positioning arrangement requires lost motion connections between various construction elements which can only operate if very precisely manufactured and assembled. Thus, the area for improvement is the reduction of the lost motion connections to a minimal amount and the formation of those that remain in a relatively simplified manner so as to be positively operable.

OBJECTS AND SUMMARY OF THE INVENTION

It is, therefore, an object of this invention to provide a latch bolt operating assembly which may have one or both of two bolt operating improvements, either of which will provide increased advantages over the prior art forms. The one bolt operating improvement includes unique elements between the main latch bolt and the rearward operator thereof which not only simplifies the force train, but assures proper force transmission in a unique manner not heretofore possible. The other bolt operating improvement is involved with the auxiliary bolt dogging of the main bolt in an extended engaged position for frustrating attempts at retracting the main bolt by means of anything but the usual bolt operating assembly.

It is a further object of this invention to provide a latch bolt operating assembly which may include a latch operating mechanism which transfers motion from a rearward operator to a latch bolt for the retraction thereof in a smooth and more efficient manner, and one which virtually eliminates any possiblity of human failure. In a preferred embodiment thereof, a spindle such as a half-round spindle transmits motion from door knobs or levers to a retractor imparting slideable motion to the retractor. The retractor is, in turn, forwardly connected both slideably and pivotally to the main bolt through a pivotal link and a unique cam, all properly arranged to provide the motion required. Also, if desired, the force transmitting connections between the link and cam may be of a mechanical advantage nature so that lesser movements of the spindle will create greater movements of the main bolt permitting the main bolt to be of maximum length for creating greater security.

It is still another object of this invention to provide a latch bolt operating assembly which may have dogging of the main bolt through an auxiliary bolt which assures positive dogging of the main bolt while the main bolt is in fully engaged position preventing violation of the main bolt by outside forces attempting to drive the same to its retracted position. In the preferred embodiment thereof, whether or not the foregoing latch operating mechanism is provided, the latch operating mechanism is connected to the main bolt through a forward and rearward floating, unlocking slide which is positioned captive in a generally U-shaped bolt extension extending rearwardly from the main bolt. The unlocking slide, in turn, has engagement means thereon which is positioned for forming a part of the control of a locking dog which is also controlled by the auxiliary bolt. Thus, during normal retraction of the main bolt from its fully engaged position by use of the normal latch operating mechanism, the engagement means of the unlocking slide disengages the locking dog and permits full retraction of the main bolt. If, however, there is an attempt to illegally retract the main bolt without making use of the normal latch operating mechanism, the engagement means of the unlocking slide does not contact the locking dog and the locking dog remains fully engaged with the main bolt preventing it from moving rearwardly and, thereby, frustrating the attempted violation.

It is still an additional object of this invention to provide a latch bolt operating assembly which may include either or both of the foregoing bolt operating improvements and which may also include an improved backset adjustment. In a preferred embodiment thereof, assume that the rearward portion of the latch operating mechanism is a retractor slide, the spindle that connects thereto for supplying forward and rearward slideable movement can connect to the retractor slide at longitudinally spaced locations depending on the backset dimensions required. In specific form, an insert is removably attached to the side of the retractor slide to serve as a forward backset position for the spindle to engage the retractor slide through the insert, or the insert may be removed providing a greater backset adjustment wherein the spindle directly engages the retractor slide. In both cases, a plastic sleeve may be assembled over the retractor slide to aid in the assembly and regardless of the insert being presently installed or removed.

Other objects and advantages of the invention will be apparent from the following specification and the accompanying drawings which are for the purpose of illustration only.

DESCRIPTION OF THE BEST EMBODIMENT CONTEMPLATED

Figure 1:
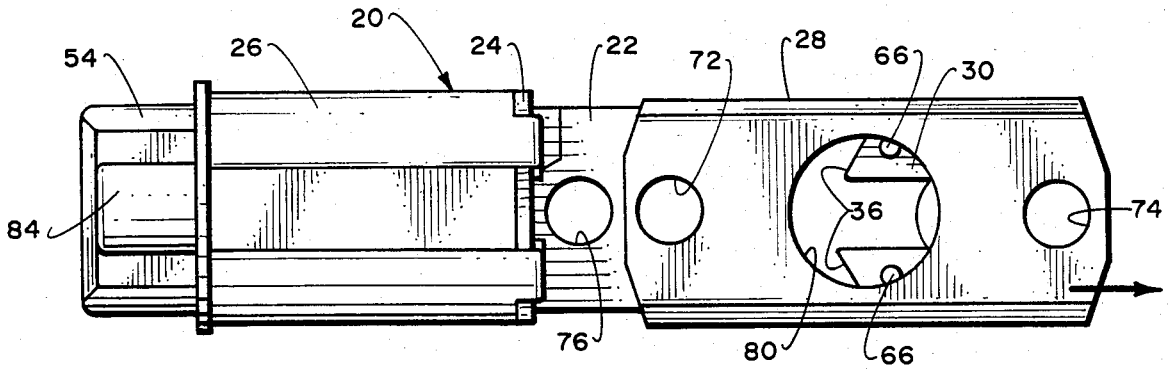
FIG. 1 is a side elevational view of a latch bolt operating assembly incorporating all of the improvements of the present invention, both the main and auxiliary bolts being shown in extended positions and the backset adjustment being in the rearward backset position with the insert removed.

Referring to the drawings, a preferred embodiment of a latch bolt operating assembly is shown therein including an improved main bolt operating mechanism, an improved auxiliary bolt operating mechanism and an improved backset adjustment. Each of these may provide advantages operating separately, but they are shown herein in a single improved structure. Furthermore, the overall assembly may be formed of usual materials and by known production methods, except where otherwise specifically pointed out.

Referring for the moment to FIGS. 3 through 6 and 14, the improved main bolt operating mechanism will primarily be described and includes a stationary latch frame generally indicated at 20 made up of a latch case extension 22 which is partially telescoped forwardly by a latch carrier 24, the latch carrier, in turn, being totally forwardly telescoped by a latch case 26. All of the case extension 22, carrier 24 and case 26 are assembled in generally usual manner, certain parts of which will be hereinafter discussed more in detail. Furthermore, a preferably plastic, latch extension sleeve 28 is telescoped over the latch case extension 22, this forming a portion of the improved backset adjustment and will also be hereinafter discussed more in detail.

A forwardly and rearwardly or longitudinally slideable, retractor slide 30 is mounted telescoped primarily by the case extension 22, although having a forward connecting portion 32 extending telescoped forwardly by the carrier 24 and case 26. The retractor slide 30, as clearly seen in FIG. 14, has a rearwardly opening cutout 34 therein which forms spindle engagement portions 36 as well as additional clearance space to permit operation of the retractor slide in movement within the case extension 22. The forward connecting portion 32 of the retractor slide 30 has a forwardly opening, pivot socket 38 formed therein and opening into the carrier 24 and case 26 for a purpose to be hereinafter described.

A cam 40 is forwardly and rearwardly or longitudinally pivotal within the latch case 26 and having a rearward portion projecting rearwardly into the carrier 24 pivotally connected to the carrier by a pivot pin 42. The cam 40 is generally longitudinally aligned with the retractor slide 30 and has a pivot socket 44 spaced slightly above the pivot pin 42 and opening generally rearwardly and generally aligned with the pivot socket 38 in the retractor slide 30. The cam 40 terminates upwardly in a pivot finger portion 46 which is obviously spaced above the pivot socket 44 and of greater distance from the pivot pin 42 pivotally tying the cam to the carrier 24 and case 26.

Figure 5:
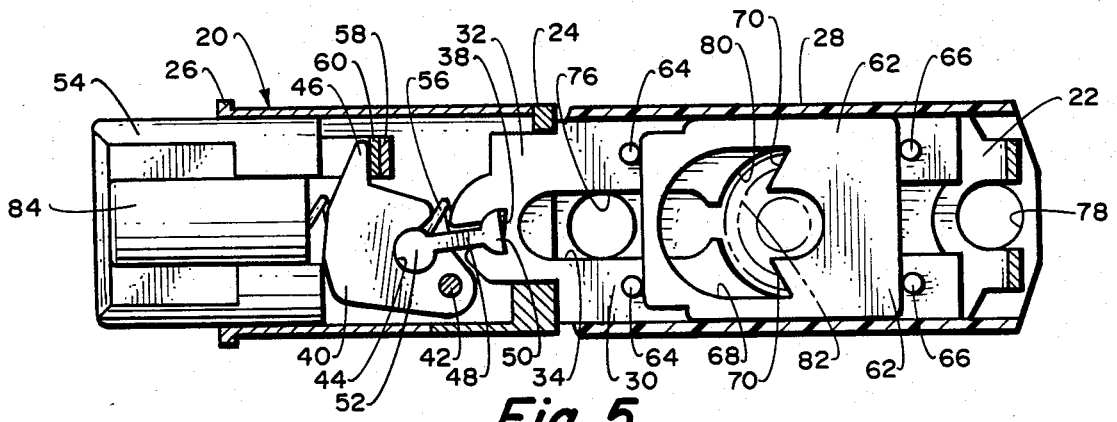
FIG. 5 is a vertical sectional view looking in the direction of the arrows 5—5 in FIG. 4.
Figure 6:
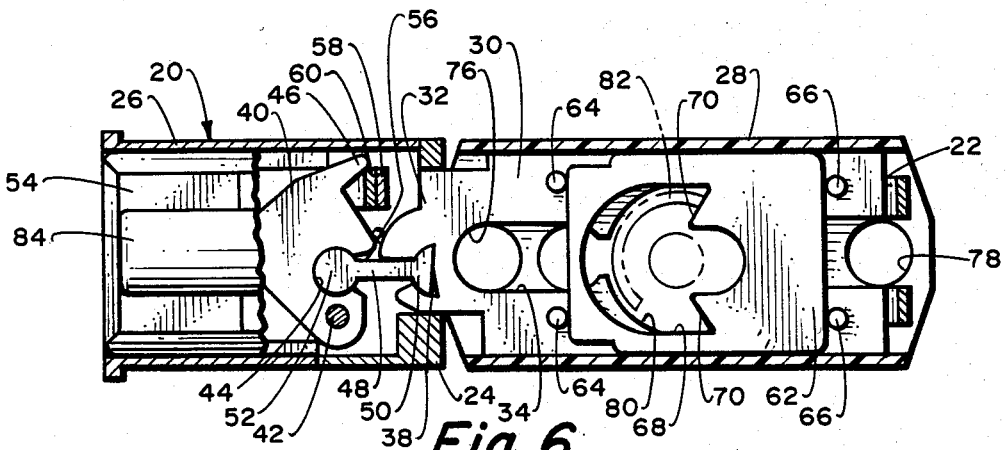
FIG. 6 is a view similar to FIG. 5 but with the latch bolt operating assembly of the present invention in fully retracted position.

A link 48 is formed with an enlarged, semi-circular end 50 trapped in the pivot socket 38 of the retractor slide 30 and an enlarged, circular end 52 trapped in the pivot socket 44 in the cam 40 as clearly shown in FIGS. 5 and 6. The circular and arcute surfaces of the pivot sockets 38 and 44 in the retractor slide 30 and the cam 40, along with the general spacing between the retractor slide and cam, are such that forward and rearward movement of the retractor slide will transmit forward and rearward, as well as pivotal motion between the retractor slide 30 and the cam 40 as a result of the link 48 movably tying the two together. The movement of the retractor slide 30 is forward and rearward slideable movement, while the movement of the cam 40 is forward and rearward pivotal movement.

Figure 3:
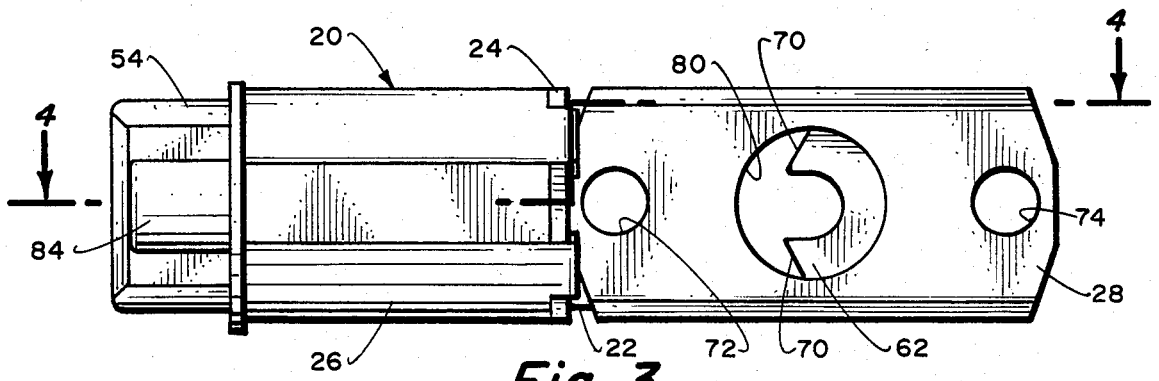
FIG. 3 is a view similar to FIG. 1, but with the backset insert assembled in place and the latch extension sleeve properly assembled for the latch bolt operating assembly to be in forward backset position.
Figure 4:
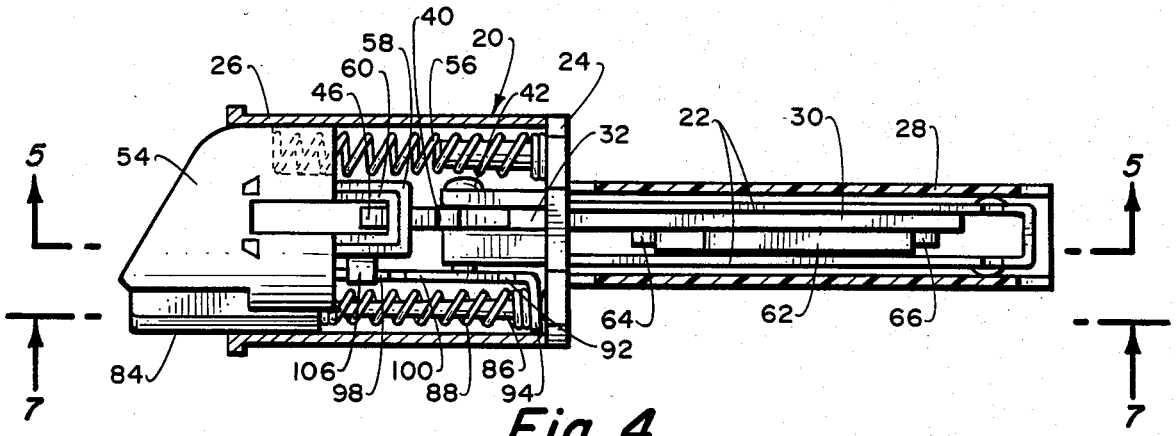
FIG. 4 is a horizontal sectional view looking in the direction of the arrows 4—4 in FIG. 3.

Finally, a main bolt 54 is forwardly and rearwardly movable between an extended position extending partially from the latch case 26 as shown in FIGS. 3, 4 and 5, and retracted position fully within the latch case as shown in FIG. 6. The main bolt 54 is mounted with a main bolt spring 56, the spring normally forcing the main bolt to its extended position and being compressed upon movement of the main bolt to its retracted position. For this reason, this particular embodiment of the latch bolt operating assembly of the present invention is known as a spring latch type device, that is, spring urged to extended position and spring compression permitting the bolt to be drawn to its retracted position.

A reversely U-shaped, bolt extension 58 is secured extending rearwardly from the main bolt 54 so that forward and rearward movement of the bolt extension will cause the forward and rearward movement of the main bolt. A similarly contoured, generally U-shaped, unlocking slide 60 is telescoped within the bolt extension 58 for slideable movement forwardly and rearwardly a limited distance relative to the bolt extension. Without going into the purpose of this slideable movement of the unlocking slide 60 relative to the bolt extension 58 for the moment, the assembly between the main bolt 54 and the cam 40 is with the pivot finger portion 46 of the cam received upwardly in and reversely rearwardly against the unlocking slide 60 as clearly shown in FIGS. 4 and 5.

Finally, the overall assembly necessary for illustrating proper operation of this preferred embodiment of the improved main bolt operating mechanism is basically shown, for instance, as including an insert 62 which lies against the retractor slide 30 engaging forwardly with the forward positioning lugs 64 and rearwardly with the rearward positioning lugs 66 so as to cover the spindle engagement portions 36 of the retractor slide. The purpose of using or not using the insert 62 will be discussed later, but for present purposes, the insert 62 has a cutout 68 with transversely spaced, spindle engagement portions 70, therefore this insert cutout 68 appearing much the same as the retractor slide cutout 34 but forwardly thereof, again the particulars of which will be discussed at a later time. With the insert 62 present, the latch extensions sleeve 28 is in the forward position shown so that forward fastener holes 72 and rearward fastener holes 74 properly align with similar forward and rearward fastener holes 76 and 78 in the latch case extension 22 and equally important, so that an enlarged, spindle opening 80 of the latch extension sleeve 28 coincides with the spindle engagement portions 70 of the insert 62. A somewhat usual half-round spindle 82 is inserted through the spindle opening 80 of the latch extension sleeve 28 and engaged with the spindle engagement portion 70 of the insert 62, the spindle at one or both of its ends being connected with a door knob or lever in order to supply the well known motion.

The operability of the embodiment of the improved main bolt operating mechanism as thus far described can be illustrated in FIGS. 4, 5 and 6. Starting with the main bolt 54 in its fully extended position as shown in FIGS. 4 and 5, the movement to the main bolt retracted position is started by rotating the spindle 82 in either direction which exerts pressure rearwardly on one spindle engagement portion 70 of the insert 62. This rearward intended motion is transferred from the insert 62 into the retractor slide 30 moving the retractor slide rearwardly and urging the cam 40 to pivot rearwardly around the pivot pin 42 as caused by the connection of the link 48 between the retractor slide and cam.

Obviously, as shown by comparing FIGS. 5 and 6, the pivoting of the cam 40 directs rearward motion to the unlocking slide 60 and since it is rearward tightly against the bolt extension 58, this rearward motion is transmitted to the main bolt 54. Rearward movement of the main bolt 54 begins the withdrawal thereof from the position of FIG. 5 to the position of FIG. 6 so that the main bolt is ultimately moved rearwardly to its fully retracted position as shown in FIG. 6. Merely releasing the spindle 82 will permit the main bolt spring 56, which has been compressing, to move the main bolt 54 back to its fully extended position since, as previously pointed out, this is a spring latch construction.

Figure 7:
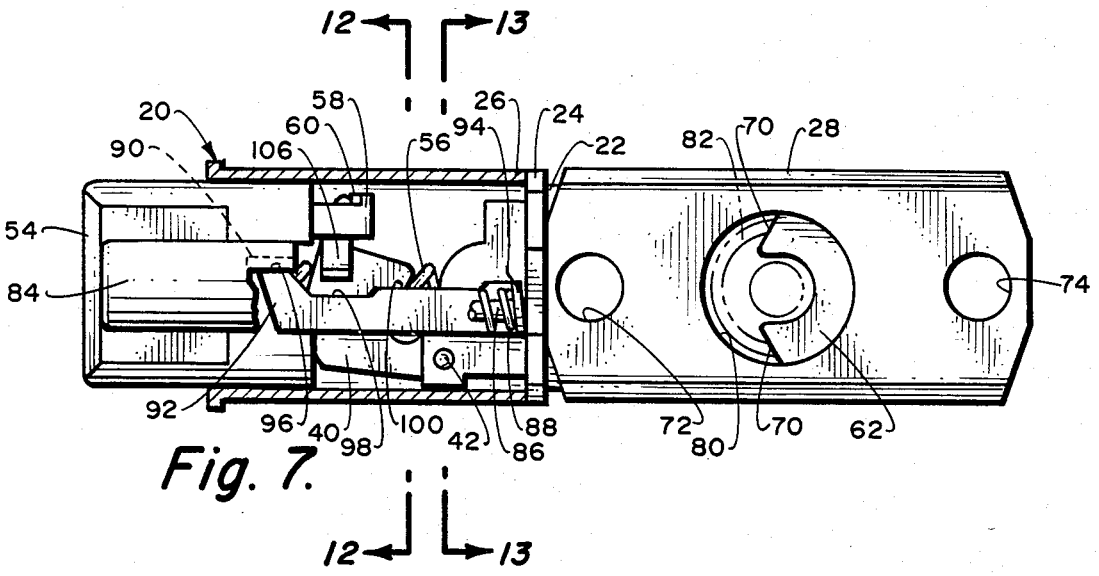
FIG. 7 is a vertical sectional view looking in the direction of the arrows 7—7 in FIG. 4, the latch bolt operating assembly being shown in both main and auxiliary bolts fully extended positions.

The improved auxiliary bolt operating mechanism of the present invention is shown in FIGS. 7 through 14 and includes an auxiliary bolt 84 which overlies the main bolt 54 and is forwardly and rearwardly slideable relative thereto. The auxiliary bolt 84 is mounted forwardly and rearwardly movable on a rod 86 backed by a spring 88 so that the auxiliary bolt is normally urged fully forwardly by the spring as shown in FIG. 4, but may be moved to various positions rearwardly during spring compression as will be hereinafter discussed in detail. The auxiliary bolt 84 has a downwardly extending shield 90 as well seen in FIGS. 7 and 14, the shield extending downwardly within the main bolt 54 when the two are extended, for instance, as shown in FIG. 7.

A locking dog 92 is positioned inwardly of the auxiliary bolt 84 generally aligned with the main bolt 54 and has a foot portion 94 secured between the rearward end of the auxiliary bolt spring 88 on the rod 86 and latch carrier 24. The locking dog foot portion 94 is specifically formed with a slight angle upwardly and forwardly relative to the latch carrier 24 as seen by comparing FIGS. 7 and 8. As shown in FIG. 7, when both the main and auxiliary bolts 54 and 84 are fully forwardly with the auxiliary bolt shield 90 and a forward edge 96 of the auxiliary bolt 84 abutting, the locking dog is held slightly downwardly so that the foot portion 94 thereof is angled slightly forwardly of the latch carrier 24, but when the shield is removed from the locking dog, the spring 88 forces the locking dog foot portion 94 back tightly against the latch carrier and the remainder of the locking dog angling slightly upwardly.

Rearwardly of the locking dog forward edge 96, the locking dog 92 is provided first with a relieved engagement edge 98 and then a slightly raised release edge 100, both edges being important to the function of the locking dog. Furthermore, the locking dog 92 extends forwardly to within the confines of the main bolt 54, and the main bolt has an upper locking notch 102 which terminates forwardly in an unlocking notch 104. Finally, the overall assembly is completed by a foot portion 106 formed on the unlocking slide 60 extending downwardly from the unlocking slide and over the engagement and release edges 98 and 100 on the locking dog 92 depending on the position of the unlocking slide relative to the locking dog and to be hereinafter explained.

In operation of the improved auxiliary bolt operating mechanism of the present invention, and assuming the use therewith of the improved main bolt operating mechanism previously described, FIG. 7 shows both the main bolt 54 and the auxiliary bolt 84 in fully extended positions so that they are not engaged with a door frame or the like. It will be noted that the forward edge 96 of the locking dog 92 lies against the shield 90 of the auxiliary bolt 84 thereby retaining the locking dog slightly downwardly against pressure of the spring 88. Furthermore, the foot portion 106 of the unlocking slide 60 is spaced above the engagement edge 98 of the locking dog 92.

Figure 11:
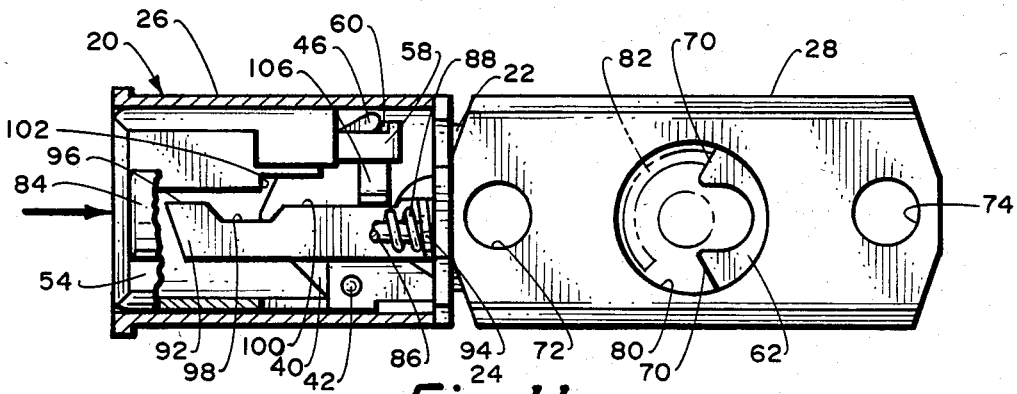
FIG. 11 is a view similar to FIG. 10 but with both the main and auxiliary bolts fully withdrawn.
Figure 12:
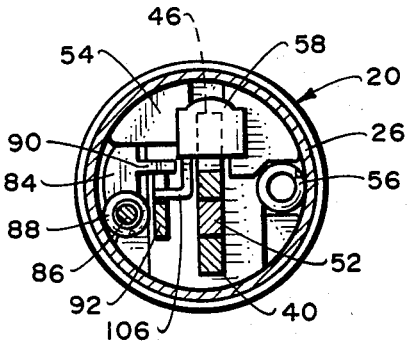
FIG. 12 is a vertical sectional view looking in the direction of the arrows 12—12 in FIG. 7.
Figure 13:
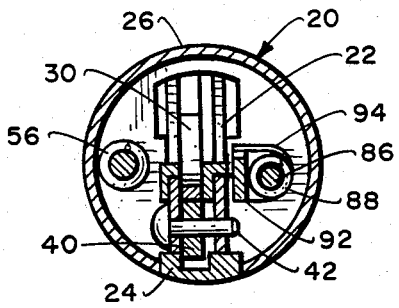
FIG. 13 is a vertical sectional view looking in the direction of the arrows 13—13 in FIG. 7.
Figure 14:
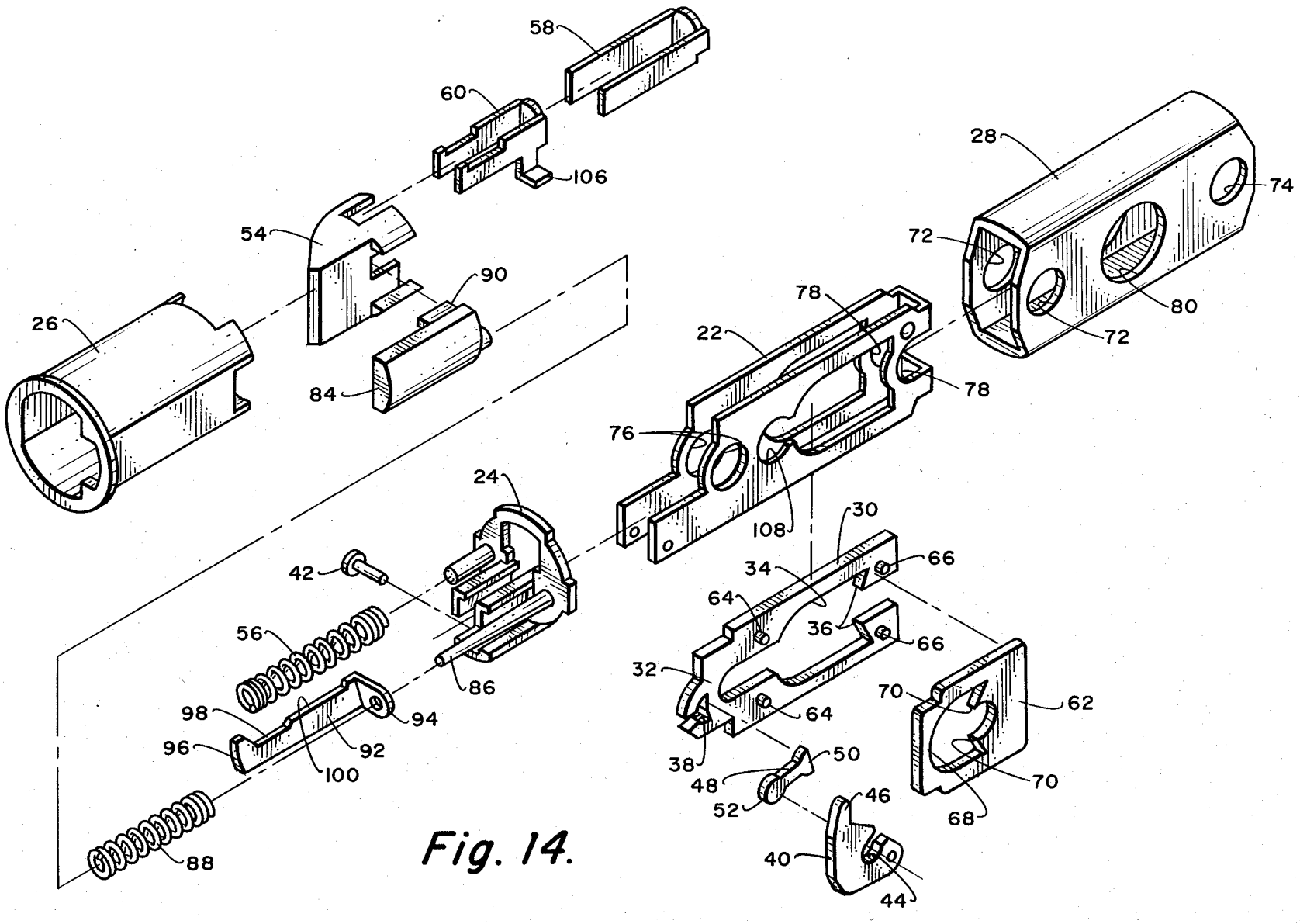
FIG. 14 is an exploded view of the latch bolt operating assembly incorporating all of the improvements of the present invention.

Assume that it is desired to engage the main bolt 54 in the keeper (not shown) of a door frame edge. The spindle 82 is partially rotated as shown in FIG. 11 and through retractor slide 30, cam 40, link 48 and the engagement of the cam pivot finger portion 46 with the unlocking slide 60, the unlocking slide moves the bolt extension 58 and thereby the main bolt 54 rearwardly. At the same time, as the auxiliary bolt 84 moves, the auxiliary bolt shield slides along the forward edge 96 of the locking dog 92 and the foot portion 106 of the unlocking slide 60 moves rearwardly relative to the locking dog finally engaging release edge 100 of the locking dog. Thus, the assembly finally reaches the fully retracted positions of both of the main and auxiliary bolts 54 and 84 as shown in FIG. 11.

Figure 8:
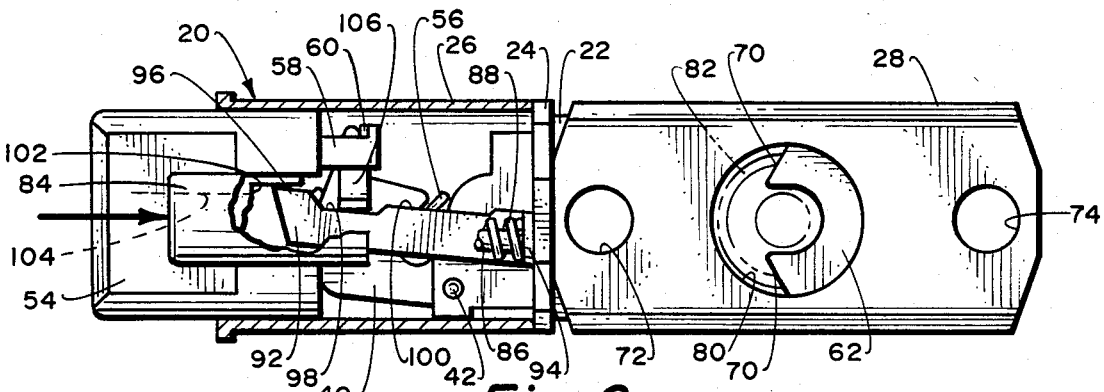
FIG. 8 is a view similar to FIG. 7 but with the auxiliary bolt retracted and the main bolt fully extended as if the latch bolt operating assembly is engaged in a door frame or the like retaining a door in close position.

The assembly is aligned with the keeper of a door frame edge and released with the main bolt 54 extending from fully retracted position as shown in FIG. 11 to fully extended position as shown in FIG. 8 by virtue of the main bolt spring 56 forcing the main bolt outwardly. The auxiliary bolt 84, however, will only extend into abutment with the keeper retaining the same in a withdrawn position. Note that as a result, the shield 90 of the auxiliary bolt 84 is withdrawn so that the forward edge 96 of the locking dog 92 engages in the locking notch 102 of the main bolt 54 slightly spaced from the inner end thereof. Also, the foot portion 106 of the unlocking slide 60 is engaged with the engagement edge 98 of the unlocking dog 92.

Figure 9:
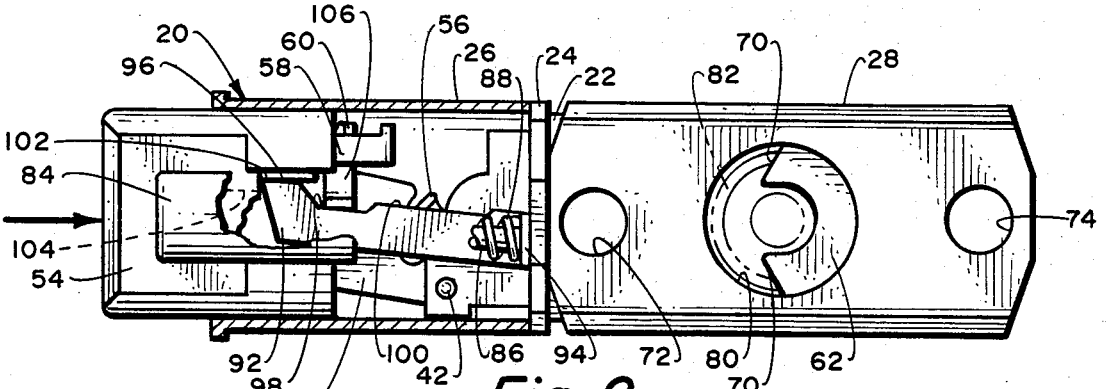
FIG. 9 is a view similar to FIG. 8 but with someone attempting to drive or force the main bolt from its position fully extended as in FIG. 8 and the main bolt dogged from the driving forces by the locking dog.

This is the locked position of the overall main and auxiliary bolt operating mechanism. Furthermore, if, for instance, an unauthorized person would attempt to unlock the mechanism from the bolt side thereof by somehow attempting to force the main bolt 54 from its extended position, the result would be as shown in FIG. 9. The main bolt 54 would move rearwardly only until the locking dog forward edge 96 reached the inner end of the main bolt locking notch 102 and at that point, the main bolt would no longer move inwardly and the mechanism would be maintained locked. You will also note that despite the fact that the main bolt 54 and its bolt extension 58 have moved slightly rearwardly, the unlocking slide 60 has not moved so that all elements rearwardly from the cam 40 are undisturbed.

Figure 10:
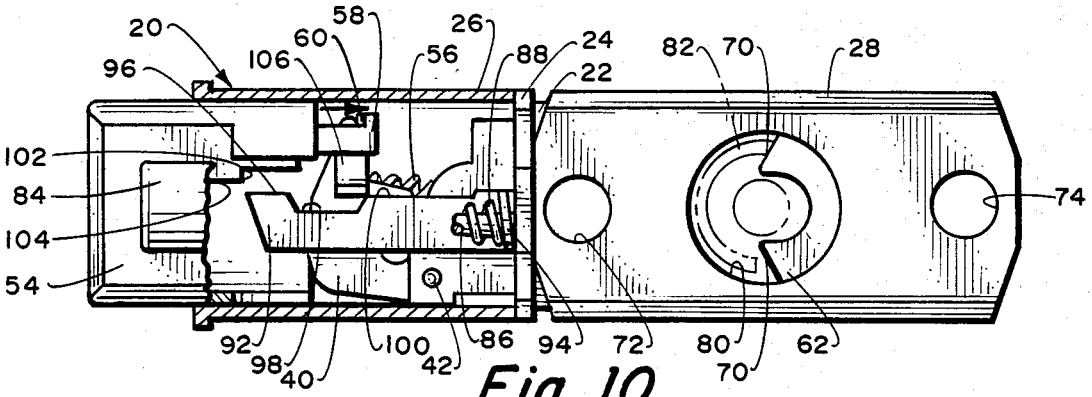
FIG. 10 is a view similar to FIG. 8 but with the main and auxiliary bolts being intially started to be properly withdrawn by the latch bolt operating assembly of the present invention.

On the other hand, if a person wants to properly open the latch mechanism, this can be accomplished in a smooth and efficient manner. Again starting with the elements in the locked position of FIG. 8, the spindle 82 is partially rotated which moves the retractor slide 30 slideably rearwardly and through the link 48, the cam 40 pivotally rearwardly. The cam pivot finger portion 46 forces the unlocking slide 60 rearwardly which moves both of the main bolt 54 and bolt extension 84 rearwardly, all as shown in FIG. 10.

In the initial movement, the locking dog forward edge 96 remains within the locking notch 102 while the unlocking slide foot portion 106 moves along the locking dog engagement edge 98. Eventually, the unlocking slide foot portion 106 arrives at and passes onto the locking dog release edge 100 and this is just prior to the locking dog forward edge engaging the main bolt locking notch 102. Thus, with the unlocking slide foot portion 106 moving to the locking dog release edge 100, the locking dog 92 is forced downwardly to the position of FIG. 10 and all further movement is in this position ultimately arriving at the fully withdrawn positions of the main and auxiliary bolts 54 and 84 as shown in FIG. 11.

The improved backset adjustment of the present invention is illustrated in FIGS. 1 through 6 and 14. Briefly, backset of a latch construction is the distance between the forward extension of the latch frame back to the center line of the spindle or other operating devices. Although there are occasional variations, it is standard practice in the industry to designate two backset adjustments, a lesser one of $2\frac{3}{8}''$ and a greater one of $2\frac{3}{4}''$. The improved backset adjustment of the present invention is illustrated herein adjustable between those two preferred dimensions.

As previously described, a particular backset adjustment is illustrated in FIGS. 3 through 6 and this would be the shorter or lesser backset of say $2\frac{3}{8}''$. As shown therein, the latch extension sleeve 28 is in its forward position over the latch case extension 22 aiding in retaining the insert 62 properly positioned engaged against the retractor slide 30 between the forward and rearward positioning lugs 64 and 66. Furthermore, in this shorter backset adjustment with the insert 62, the foward and rearward fastener holes 72, 74, 76 and 78 in the latch extension sleeve 28 and, more important, the latch case extension 22 are used for mounting the assembly.

Thus, with the shorter backset adjustment, the spindle 82 is inserted engaging the spindle engagement portions 70 of the insert 62 with the spindle engagement portions 36 of the retractor slide 30 being rearwardly spaced therefrom covered by the insert 62 and inactive in this adjustment setting. The spindle 82 can therefore be partially rotated transmitting force into the insert 62 and generating slideable movement in the retractor slide 30. As previously described, the slideable movement of the retractor slide 30 is transmitted by the link 48 into the pivoting of the cam 40 and ultimately the rearward movement of the main and auxiliary bolts 54 and 84.

Figure 2:
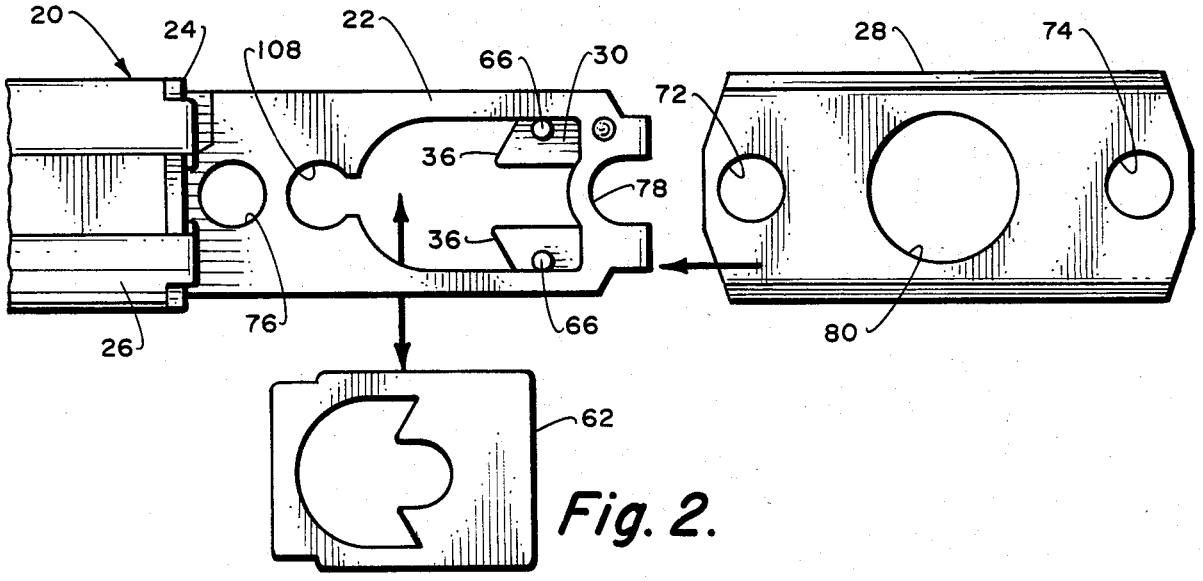
FIG. 2 is a view similar to FIG. 1 but with the latch extension sleeve removed and the backset insert aligned ready for assembly.

The greater or longer backset adjustment is illustrated in FIGS. 1 and 2. As shown therein, the insert 62 merely assembles transversely between the members of the latch case extension 22 so that it can be just as easily removed. As shown reversely in FIG. 2, the spindle 82 (not shown) is removed, the latch extension sleeve 28 slid longitudinally to disengage from the assembly and the insert 62 removed, the latch extension sleeve merely being slid back into place as shown in FIG. 1 but aligned with different fastening holes. As shown in FIG. 1, the forward fastening holes 72 of the latch extension sleeve 28 are aligned with intermediate fastener holes 108 of the latch case extension 22 which places the entire of the latch extension sleeve spaced rearwardly and the rearward fastening holes 74 thereof spaced rearwardly from the rearward fastening holes 78 of the latch case extension.

Thus, upon reassembly of the spindle 82 now engaged with the spindle engagement portions 36 of the retractor slide 30, the insert 62 being removed, partial rotation of the spindle imparts rearward slideable movement into the retractor slide 30. This, as previously described, causes rearward pivotal movement of the cam 40 as a result of the link 48 connection and ultimately creates rearward slideable movement in the main and auxiliary bolts 54 and 84. It can be seen, therefore, that either backset adjustment may be used with only slight alterations to the overall assembly, that is, merely the addition of the insert 62 for the lesser backset adjustment or the removal of the insert 62 for the greater backset adjustment.

According to the principles of the present invention, therefore, a unique latch bolt operating assembly is provided having three different areas of improvement. In the main bolt operating mechanism, a much more efficient and smoothly operating assembly is provided and one which eliminates known areas of human failure. As combined with the auxiliary bolt operating mechanism, the motion movement is simplified and the auxiliary bolt operating mechanism brings in two stage motion which is simplified, yet more positive in nature to frustrate violation attempts. Finally, an improved backset adjustment may be combined with substantially any of the foregoing and not only simplifies the method of backset adjustment heretofore provided, but does so in a simple and efficient manner.

Although the principles of the present invention have been herein illustrated in a particular embodiment of latch bolt operating assembly, it is not intended to limit such principles to that construction alone, since the same principles are literally applicable to various other forms of latch bolt operating assemblies. Thus, the principles of the present invention should be broadly construed and not limited beyond the specific limitations set forth in the appended claims including the patent equivalents thereof.

I claim:

1. In a latch construction of the type having a frame mounting a bolt movable from a forward extended position to a rearward retracted position by motion of a rearward operator acting through latch operating mechanism; the latch operating mechanism including: a retractor forwardly and rearwardly movable in said frame and having a rearward portion operably connected to the rearward operator for transferring rearward operator motions into rearward retractor movements, a cam with a base end thereof pivotally connected to said frame and a free portion thereof pivotal forwardly and rearwardly of said frame, said cam free portion being operably connected to said bolt conveying rearward motion to said bolt upon rearward pivoting of said cam; a link pivotally connected at a rearward end thereof to a forward portion of said retractor and at a forward end thereof to said cam free portion spaced from said base end; a bolt extension secured extending rearwardly from said bolt and said cam free portion positioned extending into said bolt extension.

2. In a latch construction as defined in claim 1 in which said link forward end is pivotally connected to said cam free portion spaced a lesser distance from said cam base end than said cam free portion is operably connected to said bolt.

3. In a latch construction as defined in claim 1 in which an unlocking slide is forwardly and rearwardly slideable in said bolt extension and receives said cam free portion of said cam therein.

4. In a latch construction as defined in claim 1 in which said link forward end is pivotally connected to said cam free portion spaced a lesser distance from said cam base end than said cam free portion is operably connected to said bolt; and in which an unlocking slide is forwardly and rearwardly slideable in said bolt extension and receives said cam free portion of said cam therein.

5. In a latch construction of the type having a frame mounting a bolt movable from a forward extended position to a rearward retracted position by motion of a rearward operator acting through latch operating mechanism; the latch operating mechanism including: a retractor forwardly and rearwardly movable in said frame and having a rearward portion operably connected to the rearward operator for transferring rearward operator motions into rearward retractor movements; a cam with a base end thereof pivotally connected to said frame and a free portion thereof pivotal forwardly and rearwardly of said frame, said cam free portion being operably connected to said bolt conveying rearward motion to said bolt upon rearward pivoting of said cam; a link pivotally connected at a rearward end thereof to a forward portion of said retractor and at a forward end thereof to said cam free portion spaced from said cam base end; said bolt being a main bolt and there being an auxiliary bolt which in a retracted position dogs the main bolt in extended position by use of a locking dog against all forces directly against said main bolt tending to force said main bolt to its retracted position except through said latch operating mechanism; a bolt extension secured to said main bolt; an unlocking slide forwardly and rearwardly movable relative to said bolt extension, said unlocking slide having a lug thereon, said unlocking slide when moved rearwardly by said cam of said latch operating mechanism engaging said bolt extension to retract said main bolt while at the same time engaging said lug of said unlocking slide with said locking dog to prevent dogging of said main bolt; movement of said bolt extension rearwardly independent of any unlocking slide rearward movement such as by attempted rearward forcing of said main bolt causing said locking dog to dog said main bolt in an extended position.

6. In a latch construction as defined in claim 5 in which said bolt extension is rearwardly U-shaped in cross section and telescopes said unlocking slide.

7. In a latch construction as defined in claim 5 in which said bolt extension is rearwardly U-shaped in cross section and telescopes said unlocking slide, said unlocking slide being U-shaped in cross section within said bolt extension.

8. In a latch construction as defined in claim 5 in which said unlocking slide lug is constructed and arranged remaining inactive during said locking dog dogging said main bolt in its extended position and being operable to control said locking dog against dogging said main bolt when said unlocking slide is moved rearwardly by said cam.

9. In a latch construction as defined in claim 5 in which said bolt extension is rearwardly U-shaped in cross section and telescopes said unlocking slide, said unlocking slide being U-shaped in cross section within said bolt extension; and in which said unlocking slide lug is constructed and arranged remaining inoperative during said locking dog dogging said main bolt in its extended position and being operable to control said locking dog against dogging said main bolt when said unlocking slide is moved

10. In a latch construction of the type having a frame mounting a bolt movable from a forward extended position to a rearward retracted position by motion of a rearward operator acting through latch operating mechanism; the latch operating mechanism including: a retractor forwardly and rearwardly movable in said frame and having a rearward portion operably connected to the rearward operator for transferring rearward operator motions into rearward retractor movements; a cam with a base end thereof pivotally connected to said frame and a free portion thereof pivotal forwardly and rearwardly of said frame, said cam free portion being operably connected to said bolt conveying rearward motion to said bolt upon rearward pivoting of said cam; a link pivotally connected at a rearward end thereof to a forward portion of said retractor and at a forward end thereof to said cam free portion spaced from said cam base end; said retractor rearward portion operably connected to said rearward operator formed alternately at two dimensional locations to provide two backset dimensions, one retractor rearward portion being formed directly on said retractor, another retractor rearward portion being formed by an insert removably attached to said retractor and covering said one retractor rearward portion when so installed.

11. In a latch construction as defined in claim 10 in which said link forward end is pivotally connected to said cam free portion spaced a lesser distance from said cam base end than said cam free portion is operably connected to said bolt.

12. In a latch construction as defined in claim 10 in which a bolt extension is secured extending rearwardly from said bolt and said cam free portion is positioned extending into said bolt extension.

13. In a latch construction as defined in claim 10 in which said bolt is a main bolt and there is an auxiliary bolt which in a retracted position dogs the main bolt in extended position by use of a locking dog against all forces directly against said main bolt tending to force said main bolt to its retracted position except through said latch operating mechanism; in which a bolt extension is secured to said main bolt; in which an unlocking slide is forwardly and rearwardly movable relative to said bolt extension, said unlocking slide having a lug thereon, said unlocking slide when moved rearwardly by said cam of said latch operating mechanism engages said bolt extension to retract said main bolt while at the same time engaging said lug of said unlocking slide with said locking dog to prevent dogging of said main bolt; and in which movement of said bolt extension rearwardly independent of any unlocking slide rearward movement such as by attempted rearward forcing of said main bolt causes said locking dog to dog said main bolt in an extended position.

14. In a latch construction as defined in claim 10 in which said bolt is a main bolt and there is an auxiliary bolt which in a retracted position dogs the main bolt in extended position by use of a locking dog against all forces directly against said main bolt tending to force said main bolt to its retracted position except through said latch operating mechanism; in which a bolt extension is secured to said main bolt; in which an unlocking slide is forwardly and rearwardly movable relative to said bolt extension, said unlocking slide having a lug thereon, said unlocking slide when moved rearwardly by said cam of said latch operating mechanism engages said bolt extension to retract said main bolt while at the same time engaging said lug of said unlocking slide with said locking dog to prevent dogging of said main bolt; in which movement of said bolt extension rearwardly independent of any unlocking slide rearward movement such as by attempted rearward forcing of said main bolt causes said locking dog to dog said main bolt in an extended position; and in which a removable sleeve is slideably positioned covering a portion of said retractor, said sleeve permitting latch operating mechanism movement with or without said retractor rearward portion insert.

15. In a latch construction of the type having a frame mounting a main bolt and an auxiliary bolt, the main bolt being movable from a forward extended position to a rearward retracted position by motion of a rearward operator acting through latch operating mechanism, the auxiliary bolt in retracted position dogging the main bolt in extended position by use of a locking dog against all forces directly against said main bolt tending to force said main bolt to its retracted position except through said latch operating mechanism; the latch operating mechanism including: a bolt extension secured to said main bolt; an unlocking slide forwardly and rearwardly movable relative to said bolt extension, said unlocking slide having a lug thereon, said unlocking slide when moved rearwardly by said latch operating mechanism engaging said bolt extension to retract said main bolt while at the same time engaging said lug of said unlocking slide with said locking dog to prevent dogging of said main bolt; movement of said bolt extension rearwardly independent of any unlocking slide rearward movement such as by attempted rearward forcing of said main bolt causing said locking dog to dog said main bolt in an extended position.

16. In a latch construction as defined in claim 15 in which said bolt extension secured to said main bolt extends U-shaped in cross section rearwardly from said main bolt, said bolt extension telescoping said unlocking slide with said unlocking slide being movable therein.

17. In a latch construction as defined in claim 15 in which said bolt extension is generally U-shaped in cross section and extends rearwardly from said main bolt, said unlocking slide being similarly U-shaped in cross section and movable forwardly and rearwardly therein.

18. In a latch construction as defined in claim 15 in which said unlocking slide lug is constructed and arranged remaining inactive during said locking dog dogging said main bolt in its extended position and being operable to control said locking dog against dogging said bolt when said unlocking slide is moved rearwardly by said latch operating mechanism.

19. In a latch construction as defined in claim 15 in which said bolt extension secured to said main bolt extends U-shaped in cross section rearwardly from said main bolt, said bolt extension telescoping said unlocking slide with said unlocking slide being movable therein; and in which said unlocking slide lug is constructed and arranged remaining inactive during said locking dog dogging said main bolt in its extended position and being operable to control said locking dog against dogging said bolt when said unlocking slide is moved rearwardly by said latch operating mechanism.

20. In a latch construction as defined in claim 15 in which said bolt extension is generally U-shaped in cross section and extends rearwardly from said main bolt, said unlocking slide being similarly U-shaped in cross section and movable forwardly and rearwardly therein; and in which said unlocking slide lug is constructed and arranged remaining inactive during said locking dog dogging said main bolt in its extended position and being operable to control said locking dog against dogging said bolt when said unlocking slide is moved rearwardly by said latch operating mechanism.

21. In a latch construction of the type having a frame mounting a bolt movable from a forward extended position to a rearward retracted position by motion of a rearward operator acting through latch operating mechanism; the latch operating mechanism including: a retractor forwardly and rearwardly movable in said frame and having a rearward portion operably connected to the rearward operator for transferring rearward operator motions into rearward retractor movements; a cam with a base end thereof pivotally connected to said frame and a free portion thereof pivotal forwardly and rearwardly of said frame, said cam free portion being operably connected to said bolt conveying rearward motion to said bolt upon rearward pivoting of said cam; a link pivotally connected at a rearward end thereof to a forward portion of said retractor and at a forward end thereof to said cam free portion spaced from said cam base end, said link rearward and forward ends being enlarged curved surface portions captive in each of said retractor and cam.

22. In a latch constructions as defined in claim 21 in which said link forward end is pivotally connected to said cam free portion spaced a lesser distance from said cam base end than said cam free portion is operably connected to said bolt; and in which said retractor is guided forwardly and rearwardly movable in a forward and rearward slideable motion in said frame.

* * * * *